US008757426B1

(12) United States Patent
Serrano

(10) Patent No.: US 8,757,426 B1
(45) Date of Patent: Jun. 24, 2014

(54) BEVERAGE CONTAINER WITH INTEGRATED ANCHORING SYSTEM

(71) Applicant: German J. Serrano, Miami, FL (US)

(72) Inventor: German J. Serrano, Miami, FL (US)

( * ) Notice: Subject to any disclaimer, the term of this patent is extended or adjusted under 35 U.S.C. 154(b) by 0 days.

(21) Appl. No.: 13/668,546

(22) Filed: Nov. 5, 2012

(51) Int. Cl.
*B65D 25/00* (2006.01)

(52) U.S. Cl.
USPC ..... 220/737; 220/630; 267/182

(58) Field of Classification Search
USPC ..... 220/737, 738, 668, 669, 646, 647, 625, 220/628, 630, 632, 634, 635, 638, 23.9, 220/23.91, 483; 248/311.2, 310, 206.2, 248/362, 363, 205.7; 267/180–182
See application file for complete search history.

(56) References Cited

U.S. PATENT DOCUMENTS

| | | | | |
|---|---|---|---|---|
| 327,225 | A * | 9/1885 | Bleton | 215/12.1 |
| 1,911,713 | A * | 5/1933 | Pravda | 220/816 |
| 2,607,582 | A * | 8/1952 | Jurgens | 267/180 |
| 3,021,129 | A * | 2/1962 | Maker | 267/180 |
| 3,306,566 | A * | 2/1967 | Paulson et al. | 248/346.04 |
| 4,756,497 | A * | 7/1988 | Lan | 248/205.9 |
| 4,941,635 | A * | 7/1990 | Lan | 248/346.11 |
| 4,955,493 | A * | 9/1990 | Touzani | 215/372 |
| 6,571,976 | B1 * | 6/2003 | Sonnabend | 220/483 |
| 6,581,541 | B2 * | 6/2003 | Hollinger | 119/61.54 |
| 2006/0175506 | A1 * | 8/2006 | Lan | 248/311.2 |
| 2007/0152119 | A1 * | 7/2007 | Wang | 248/205.5 |
| 2007/0228626 | A1 * | 10/2007 | Suzuki | 267/180 |
| 2008/0245947 | A1 * | 10/2008 | Webb et al. | 248/683 |
| 2009/0050758 | A1 * | 2/2009 | Carnevali | 248/205.8 |
| 2010/0239407 | A1 * | 9/2010 | Mills | 414/800 |

* cited by examiner

*Primary Examiner* — Fenn Mathew
*Assistant Examiner* — Robert Stodola
(74) *Attorney, Agent, or Firm* — Albert Bordas, P.A.

(57) ABSTRACT

A beverage container with integrated anchoring system, having a container assembly, a housing assembly, a spring assembly, an anchor assembly, and a base assembly. The anchor assembly anchors onto a surface, such as a tabletop, when a downward force is placed onto the container or housing assembly to keep the beverage container with integrated anchoring system stationary. The anchor assembly releases from the surface when a predetermined rotational force is placed onto the housing or base assembly.

15 Claims, 7 Drawing Sheets

BEVERAGE CONTAINER WITH INTEGRATED ANCHORING SYSTEM

BACKGROUND OF THE INVENTION

1. Field of the Invention

The present invention relates to containers, and more particularly, to beverage containers having integrated anchoring systems.

2. Description of the Related Art

Containers having beverages therein often spill. Applicant is not aware of any prior art suggesting the novel features of the present invention.

SUMMARY OF THE INVENTION

The instant invention is a container having an integrated anchoring system, comprising a container assembly, a housing assembly, a spring assembly, an anchor assembly, and a base assembly, whereby the anchor assembly anchors onto a surface when a downward force is placed onto the housing assembly. The anchor assembly releases from the surface when a predetermined rotational force is placed onto the housing or base assembly.

The housing assembly receives the container assembly, and the spring assembly is positioned between the housing assembly and the base assembly. The spring assembly is positioned exteriorly to the housing assembly. The housing assembly comprises at least one protrusion outwardly protruding therefrom.

The anchor assembly is mounted onto the housing assembly and comprises a suction cup. The suction cup comprises at least one arm having a hole. The at least one arm having the hole is secured onto the at least one protrusion respectively.

The housing assembly comprises at least one first and second elongated protrusions outwardly protruding therefrom. The at least one first and second elongated protrusions are approximately perpendicular to each other. The base assembly comprises at least one first and second interior protrusions. The at least one first and second interior protrusions define a channel between them. The channel receives the at least one first elongated protrusion when the base assembly receives the housing assembly partially within. The housing assembly comprises at least one channel positioned between an upper sidewall and a lower sidewall.

The spring assembly comprises a base having at least two elevations. The spring assembly further comprises pluralities of arms, each having distal ends. The pluralities of arms extend from the base at a predetermined angle. One elevation mounts onto a respective first elongated protrusion, and distal ends are positioned within the at least one channel, when the spring assembly is positioned between the housing assembly and the base assembly.

It is therefore one of the main objects of the present invention to provide a beverage container having an integrated anchoring system.

It is another object of this invention to provide a container having an integrated anchoring system, comprising a container assembly, a housing assembly, a spring assembly, an anchor assembly, and a base assembly, whereby the anchor assembly anchors onto a surface when a downward force is placed onto the container or housing assembly.

It is another object of this invention to provide a container having an integrated anchoring system, whereby the anchor assembly releases from the surface when a predetermined rotational force is placed onto the housing or base assembly.

It is another object of this invention to provide a container having an integrated anchoring system that can be mounted onto any smooth surface.

It is another object of this invention to provide a container having an integrated anchoring system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
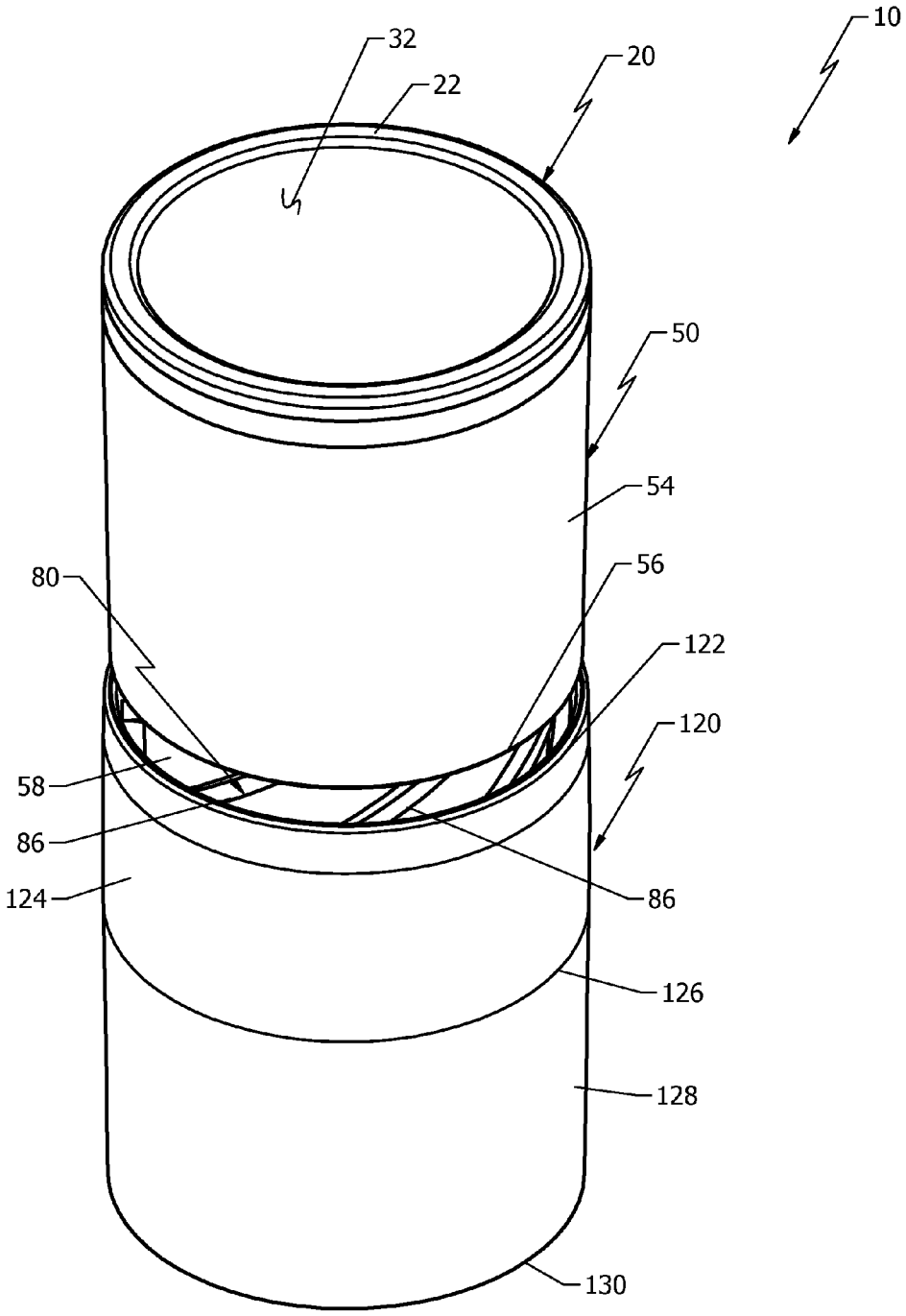
FIG. 1 is a first isometric view of the present invention.

Referring now to the drawings, the present invention is a container with an integrated anchoring system and is generally referred to with numeral 10. It can be observed that it basically includes container assembly 20, housing assembly 50, spring assembly 80, anchor assembly 100, and base assembly 120.

Figure 2:
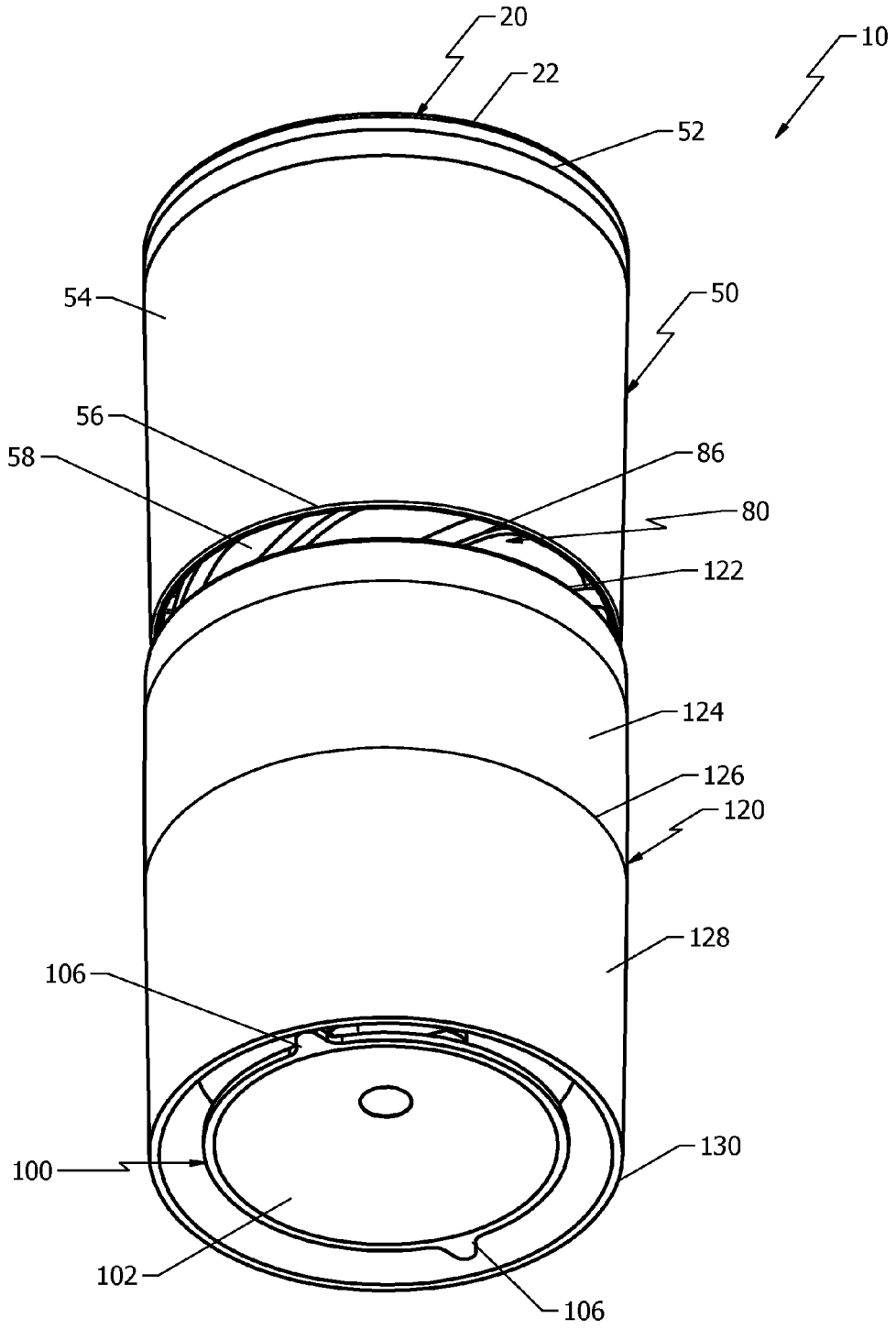
FIG. 2 is a second isometric view of the present invention.
Figure 3:
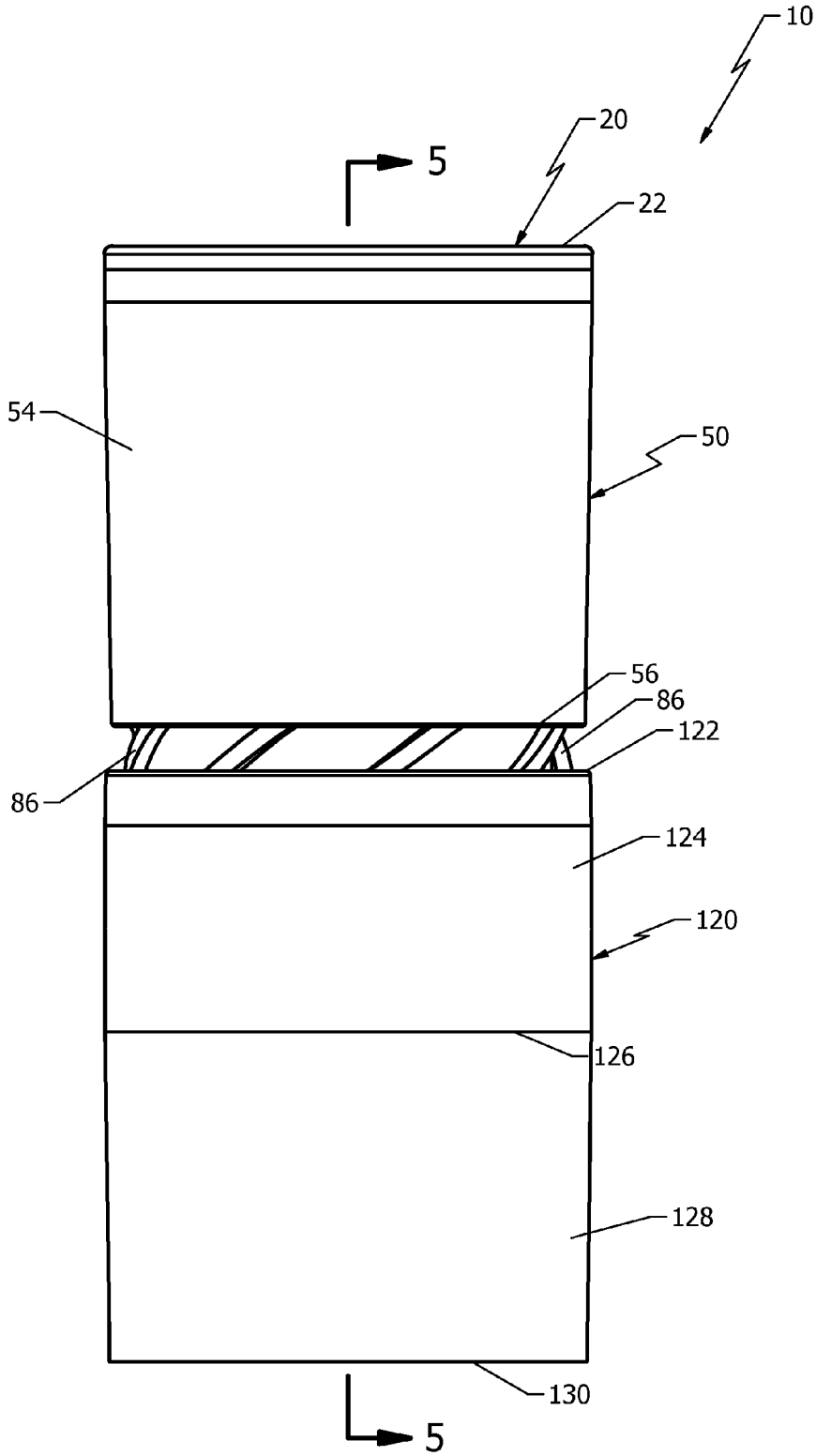
FIG. 3 is a front elevational view of the present invention.

As seen in FIGS. 1, 2, and 3 present invention 10 is a container with an integrated anchoring system. In one embodiment, the container is a beverage container, whereby matter is placed into container assembly 20 within cavity 32. The matter can be any liquid matter, semi-solid matter, solid matter, or any combination thereof such as, but not limited to, water, tea, soda, beer, coffee, wine, juice, milk, etc. Present invention 10 houses the matter for a user to drink from. When assembled as illustrated in FIGS. 1, 2, and 3 housing assembly 50 receives container assembly 20, and spring assembly 80 is positioned between housing assembly 50 and base assembly 120.

Figure 4:
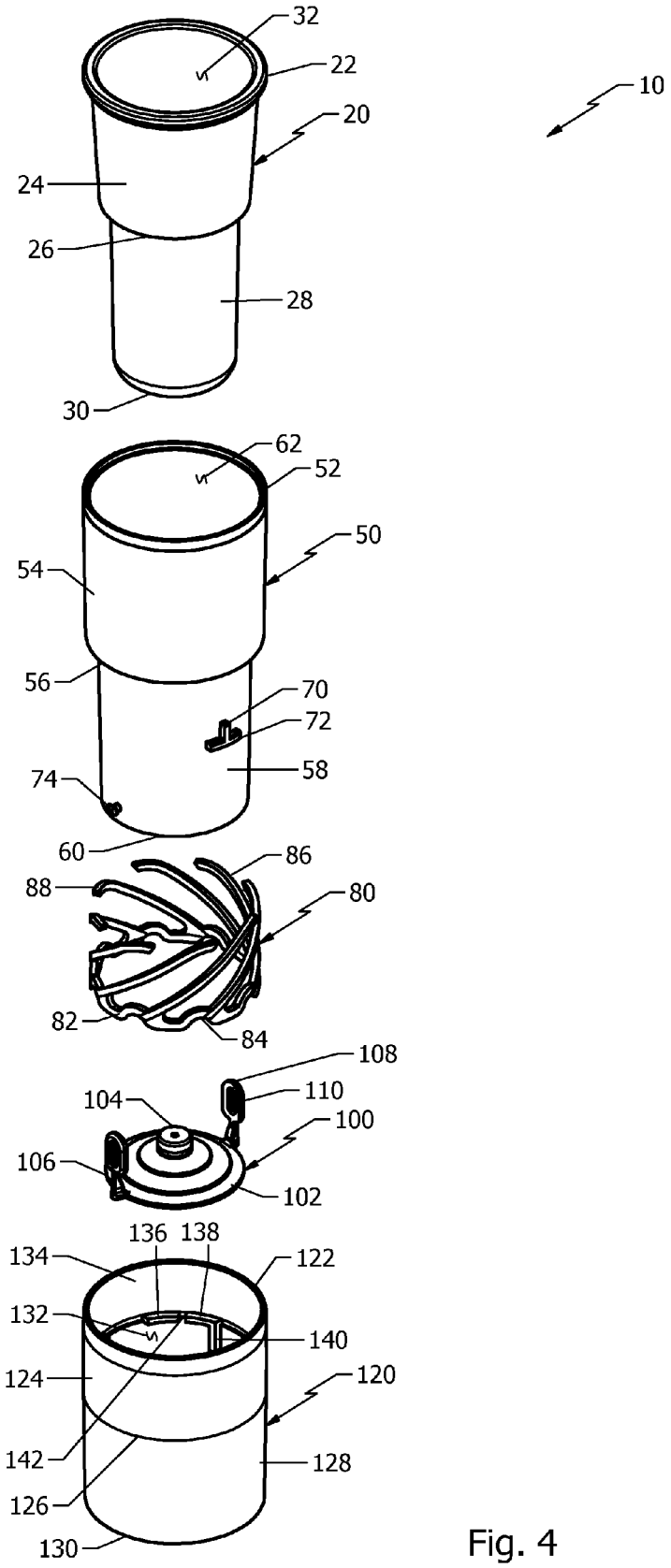
FIG. 4 is an exploded view of the present invention.

As best seen in FIG. 4, container assembly 20 comprises top edge 22 and bottom face 30. Extending downwardly from top edge 22 is upper sidewall 24 that extends to step 26. Lower sidewall 28 extends from step 26 to bottom face 30. Container assembly 20 defines cavity 32. It is noted that top edge 22 comprises a curved lip to snugly fit over top edge 52 of housing assembly 50. The curved lip is ergonomically designed for user comfort to drink from present invention 10 without dripping the matter therefrom.

Housing assembly 50 comprises top edge 52 and bottom face 60. Extending downwardly from top edge 52 is upper sidewall 54 that extends to edge 56. Lower sidewall 58 extends from edge 56 to bottom face 60. Housing assembly 50 defines cavity 62. Housing assembly 50 snugly receives container assembly 20.

Housing assembly 50 comprises at least one protrusion 74 outwardly protruding therefrom. In a preferred embodiment, housing assembly 50 comprises two protrusions 74, illustrated in FIGS. 4 and 5, positioned approximately 180 degrees from each other. At least one protrusion 74 is cooperatively shaped to secure a respective arm 106 at hole 110. At least one protrusion 74 may therefore be shaped as a protrusion with a lip, hook, or any other configuration to secure arm 106 at hole 110.

Housing assembly 50 also comprises at least one first and second elongated protrusions 70 and 72 respectively, outwardly protruding therefrom. In a preferred embodiment, at least one first and second elongated protrusions 70 and 72 respectively are approximately perpendicular to each other. Although not illustrated, it is noted that the housing assembly 50 illustrated in FIG. 4 comprises two first and second elongated protrusions 70 and 72 respectively, the first one is illustrated and the second one positioned also on lower sidewall 58 at approximately at 180 degrees from the first one.

Spring assembly 80 comprises base 82 having at least two elevations 84, and further comprises pluralities of arms 86 having respective distal ends 88. Pluralities of arms 86 extend from base 82 at a predetermined angle. One elevation 84 mounts onto a respective first elongated protrusion 70, and distal ends 88 fit within channel 57, best seen in FIG. 5, when spring assembly 80 is positioned between housing assembly 50 and base assembly 120.

Anchor assembly 100 comprises suction cup 102. Suction cup 102 comprises at least one arm 106 having a respective hole 110 at end 108. At least one arm 106 having its hole 110 is secured onto its respective at least one protrusion 74. In a preferred embodiment, at least one arm 106 extends from an outside perimeter section of suction cup 102. For stability and improved structural integrity of anchor assembly 100, anchor assembly 100 further comprises elevated alignment section 104 that fits within anchor assembly housing 64 on bottom face 60, seen in FIG. 5. In a preferred embodiment, elevated alignment section 104 is centrally disposed on suction cup 102 as illustrated.

Figure 5:
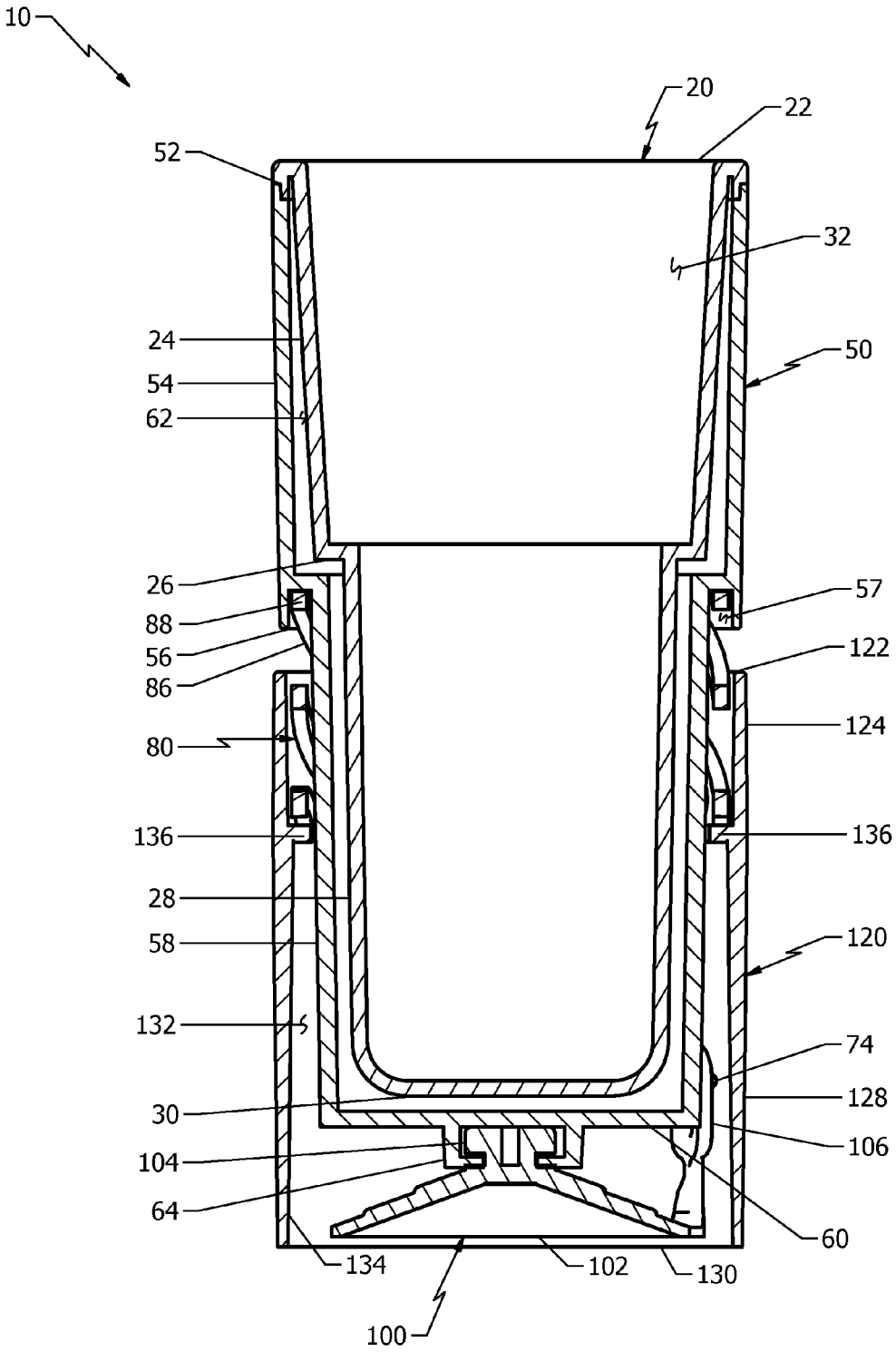
FIG. 5 is a cross-section view taken along lines 5-5 from FIG. 3.

Base assembly 120 comprises top edge 122 and bottom edge 130. Extending downwardly from top edge 122 is upper sidewall 124 that extends to line 126. Lower sidewall 128 extends from line 126 to bottom edge 130. Base assembly 120 defines cavity 132. Base assembly 120 further comprises interior sidewall 134 having at least one first and second interior protrusions 136 and 138 respectively. At least one first and second interior protrusions 136 and 138 define channel 142 between them. Channel 142 receives its respective first elongated protrusion 70 when base assembly 120 receives housing assembly 50 partially within as illustrated in FIG. 5. In a preferred embodiment, base assembly 120 further comprises third interior protrusion 140 extending from second interior protrusion 138. Third interior protrusion 140 serves as a stopper to limit travel of second elongated protrusion 72 when base assembly 120 initially receives housing assembly 50 partially within as illustrated in FIG. 5.

As best seen in FIG. 5, spring assembly 80 is positioned exteriorly to housing assembly 50, and anchor assembly 100 is mounted onto housing assembly 50. In addition, extending downwardly from top edge 52 is upper sidewall 54 that extends to edge 56 to define channel 57.

Figure 6:
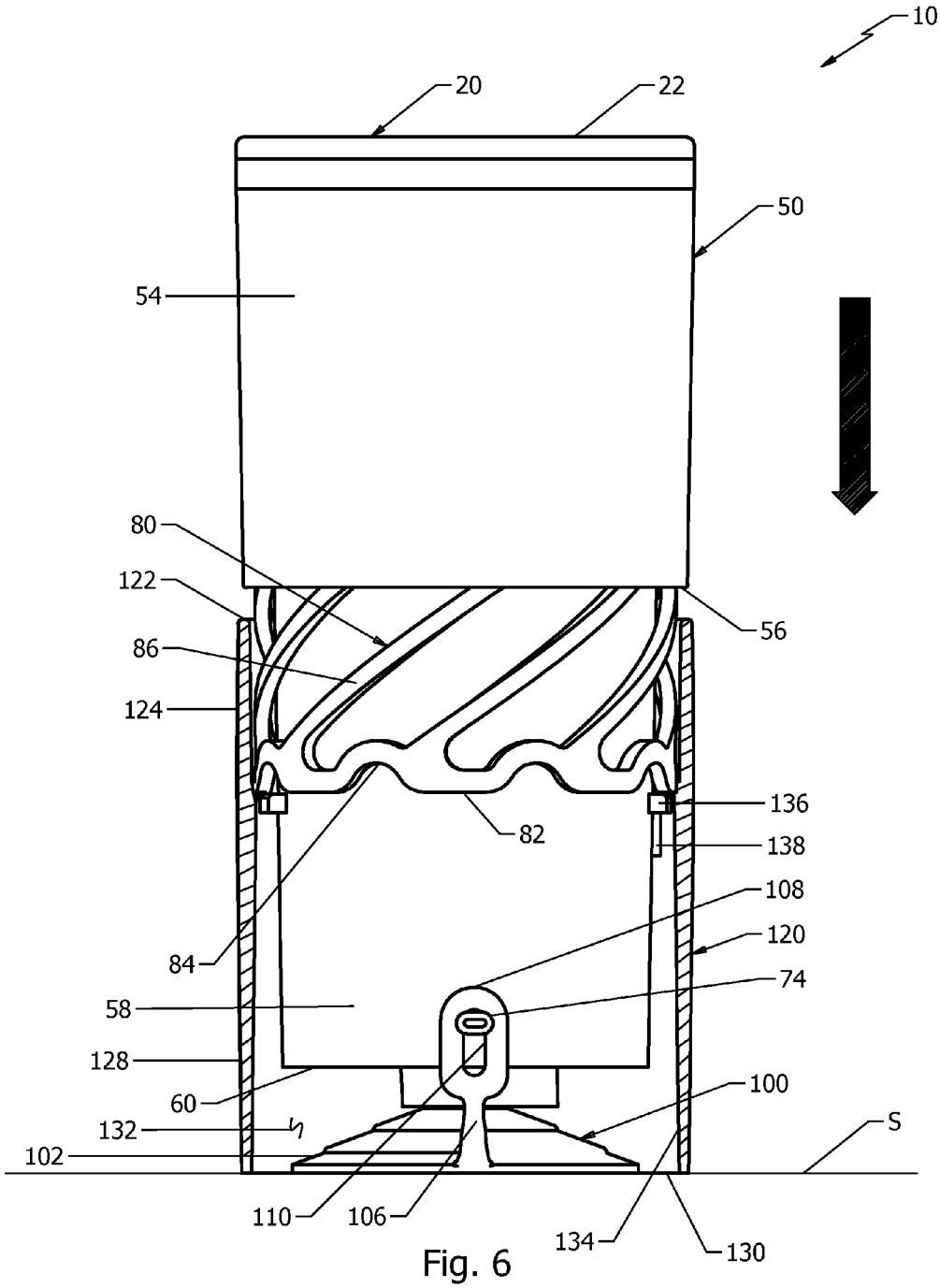
FIG. 6 illustrates a downward force being applied onto the present invention to cause the anchor assembly to anchor onto a surface.

As seen in FIG. 6, anchor assembly 100 anchors onto surface S when a downward force is placed onto container assembly 20 and/or housing assembly 50. Once anchored, instant invention 10 remains stationary to prevent it from being accidentally knocked over and having its contents spilled. In a preferred embodiment, anchor assembly 100, and specifically suction cup 102, is made of a silicone material or other material having similar characteristics enabling anchor assembly 100 to effectively adhere or anchor onto surface S.

Figure 7:
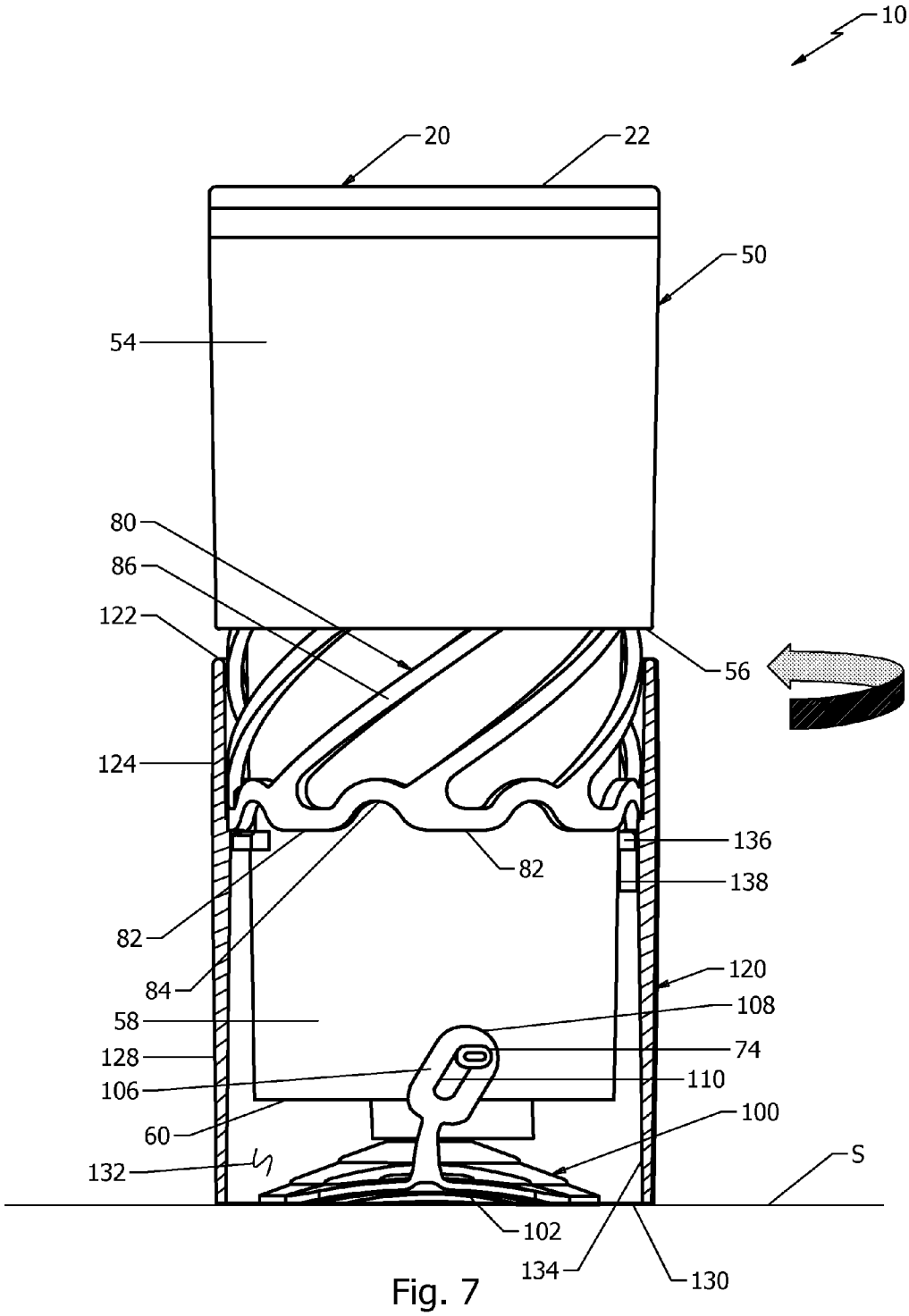
FIG. 7 illustrates a rotational force being applies onto the present invention to cause the anchor assembly to release from the surface.

As seen in FIG. 7, anchor assembly 100 releases from surface S when a predetermined rotational force is placed onto housing assembly 50 or base assembly 120, whereby the predetermined rotational force transfers from the at least one protrusion 74 to its respective arm 106. Thus, slightly elevating or lifting the outside perimeter section of suction cup 102 where arm 106 extends from. Therefore releasing any vacuum pressure and causing anchor assembly 100 to release from surface S.

In a preferred embodiment, present invention 10 is a container with an integrated anchoring system, whereby matter is placed into container assembly 20 within cavity 32. It is noted that present invention 10 may be wider, narrower, shorter, and/or taller to take the form of any container able to contain matter within cavity 32. Specifically, present invention 10 can take the shape of a bowl, plate, cup, or sippy cup as an example.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container with integrated anchoring system, comprising:

A) a container assembly;

B) a housing assembly comprising at least one protrusion outwardly protruding therefrom;

C) a spring assembly;

D) an anchor assembly comprising an outer perimeter and at least one arm located at said outer perimeter, said anchor assembly further comprising a suction cup, said suction cup comprises said at least one arm having a hole that is secured onto said at least one protrusion respectively; and E) a base assembly, said anchor assembly anchors onto a surface when a downward force is placed onto said container or housing assembly and said anchor assembly releases from said surface when a predetermined rotational force is placed onto said housing or base assembly.

2. The container with integrated anchoring system set forth in claim 1, further characterized in that said housing assembly receives said container assembly.

3. The container with integrated anchoring system set forth in claim 1, further characterized in that said spring assembly is positioned between said housing assembly and said base assembly.

4. The container with integrated anchoring system set forth in claim 1, further characterized in that said spring assembly is positioned exteriorly to said housing assembly.

5. The container with integrated anchoring system set forth in claim 1, further characterized in that said anchor assembly is mounted onto said housing assembly.

6. The container with integrated anchoring system set forth in claim 1, further characterized in that said housing assembly comprises at least one first and second elongated protrusions outwardly protruding therefrom.

7. The container with integrated anchoring system set forth in claim 6, further characterized in that said at least one first and second elongated protrusions are approximately perpendicular to each other.

8. The container with integrated anchoring system set forth in claim 6, further characterized in that said base assembly comprises at least one first and second interior protrusions.

9. The container with integrated anchoring system set forth in claim 8, further characterized in that said at least one first and second interior protrusions define a channel between them.

10. The container with integrated anchoring system set forth in claim 9, further characterized in that said channel receives said at least one first elongated protrusion when said base assembly receives said housing assembly partially within.

11. The container with integrated anchoring system set forth in claim 6, further characterized in that said housing assembly comprises at least one channel positioned between an upper sidewall and a lower sidewall.

12. The container with integrated anchoring system set forth in claim 11, further characterized in that said spring assembly comprises a base having at least two elevations, said spring assembly further comprises a plurality of arms, each having distal ends.

13. The container with integrated anchoring system set forth in claim 12, further characterized in that said plurality of arms extend from said base at a predetermined angle.

14. The container with integrated anchoring system set forth in claim 12, further characterized in that said at least two elevations mount onto said at least one first elongated protrusion when said spring assembly is positioned between said housing assembly and said base assembly.

15. The container with integrated anchoring system set forth in claim 12, further characterized in that said distal ends are positioned within said at least one channel when said spring assembly is positioned between said housing assembly and said base assembly.

* * * * *